US006122879A

United States Patent [19]

Montes

[11] Patent Number: 6,122,879

[45] Date of Patent: Sep. 26, 2000

[54] SNAP TOGETHER INSULATED PANELS

[75] Inventor: Mario Montes, Ft. Lauderdale, Fla.

[73] Assignee: Worldwide Refrigeration Industries, Inc., Hialeah, Fla.

[21] Appl. No.: 09/287,449

[22] Filed: Apr. 7, 1999

[51] Int. Cl.[7] ..... E04C 2/292; E04C 2/34

[52] U.S. Cl. ..... 52/592.1; 52/309.9; 52/592.4; 52/592.5; 52/592.6; 52/792.1; 52/794.1

[58] Field of Search ..... 52/309.9, 592.1, 52/592.4, 592.5, 592.6, 792.1, 794.1

[56] References Cited

U.S. PATENT DOCUMENTS

| | | | |
|---|---|---|---|
| 4,299,070 | 11/1981 | Oltmanns et al. . | |
| 4,453,349 | 6/1984 | Ryan . | |
| 4,769,963 | 9/1988 | Meyerson . | |
| 4,998,396 | 3/1991 | Palmersten . | |
| 5,086,599 | 2/1992 | Meyerson . | |
| 5,092,095 | 3/1992 | Zadok et al. | 52/588.1 |
| 5,138,812 | 8/1992 | Palmersten . | |
| 5,216,861 | 6/1993 | Meyerson . | |
| 5,247,770 | 9/1993 | Ting . | |
| 5,274,979 | 1/1994 | Tsai . | |
| 5,293,728 | 3/1994 | Christopher et al. | 52/309.9 X |
| 5,343,665 | 9/1994 | Palmersten . | |
| 5,349,796 | 9/1994 | Meyerson . | |
| 5,410,849 | 5/1995 | Christopher . | |
| 5,448,865 | 9/1995 | Palmersten . | |
| 5,457,917 | 10/1995 | Palmersten . | |
| 5,502,939 | 4/1996 | Zadok et al. | 52/592.1 X |
| 5,664,386 | 9/1997 | Palmersten . | |

*Primary Examiner*—Christopher T. Kent
*Attorney, Agent, or Firm*—D. Peter Hochberg; William H. Holt

[57] ABSTRACT

A refrigeration panel system is provided having a first panel and a second panel. Each of the panels has an insulated core and a top and bottom metal skin attached to the insulation core. The first panel includes a groove at an end of the insulation core of the first panel. The second panel includes a tongue formed on the end of the insulation core of the second panel. The groove is adapted to receive and surround the tongue. Interlocking engagement members are disposed inside the groove and along the tongue, and provide a biasing force that pulls and holds the end of the first panel and the end of the second panel together, after the tongue is inserted into the groove and pushed past a predetermined point.

19 Claims, 6 Drawing Sheets

SNAP TOGETHER INSULATED PANELS

BACKGROUND OF THE INVENTION

1. Field of the Invention

This invention refers to refrigeration systems, and in particular, to snap together insulated panels for walk-in freezers and cooler applications.

2. Description of the Prior Art

Snap together panels for walk-in freezers and coolers were initially designed for general construction applications, such as awnings and roofs. These types of panels have major deficiencies when used for walk-in freezers and cooler applications. First, the present snap together panels are difficult to install. As the current snap together panels were basically designed for roofing applications, they were meant to be installed horizontally. Therefore, when trying to install these panels vertically to form the walls of a cooler, which could be as tall as 16 feet, they become extremely difficult to control when trying to push the panels together and get the metal associated with the panels to connect together and hold the panels in place. Additionally, this makes it apparent that the metal designs used in snapping the panels to one another are not appropriate for vertical applications.

Further, in many designs when the panels are finally snapped together, they still are not held firmly in place by the interlocking metal. There is a significant amount of play, which makes the insulation of the subsequent panel even more difficult. Some versions of snap together paneling use a vertical spline to hold the panels to one another in a more secure structure. Use of the spline increases the cost and labor involved in the installation. In other paneling systems, screws are actually used to hold the panels in place permanently, which again increases the cost and time required for the installation.

Sometimes during the installation of walk-in freezers and coolers, it may be necessary to remove some panels from the cooler or freezer and reinstall new panels in their place. In most current snap together panel designs, this is extremely difficult to do and usually results in damage to the panel. In some cases, the damage is severe enough that the panels can no longer be used. This is due to the inaccuracy of the metal design for snapping together the insulated panels.

Another problem with present day snap together panels is that they make it difficult to move walk-in freezers and coolers. One of the major selling points for using modular panels in the construction of walk-in freezers and coolers is the ease of moving the room or rooms should it become necessary. With the present design of snap together panels, this becomes virtually impossible for the reasons stated above.

Another problem has to do with the condensation and heat infiltration around the seams between the panels. In some designs the amount of insulation in the seam area between the panels is less than the actual width of the panel. The amount and type of insulation required in a panel is calculated based on a temperature, which the room must maintain, and the size of equipment to be installed. If the proper amount of insulation is not present throughout the room, then heat is allowed to infiltrate from outside and two things can occur. First, condensation forms and can create puddles of water on the floor, which is a safety hazard to those working in or around the freezers or coolers. In the case of a freezer, these puddles may become frozen, creating a very dangerous situation for those going in and out of the room. Secondly, if the heat infiltration is severe enough, the room may be unable to hold the desired temperature with the equipment installed. Also, if the seam between the panels is not held securely, then the seal provided by using caulkings and silicones can be disturbed enough to allow air to infiltrate from the outside. This problem becomes accentuated when the room must maintain lower temperatures.

Most present day snap together panels use a variety of configuration of metal skins that extend from the end of the insulation core for interaction with the complimentary end on an adjacent panel. Most of these configurations curl around one another, so as to prevent any moisture passing through the seams of the panels. This is because most of the snap together panels were initially designed for roofing applications and/or awning applications. Further caulking is placed inside the metal connectors to create a seal for keeping out moisture. These can cause the metal to bend and become destroyed when replacing panels or moving the freezer or cooler. Finally, placing the connection on the outside of the insulation core causes the heat infiltration problems as discussed above.

SUMMARY OF THE INVENTION

In accordance with the preferred embodiment of the present invention, a refrigeration panel system is provided having a first panel and a second panel. Each of the panels has an insulation core. The first panel includes a groove at a first end of its insulation core. The second panel includes a tongue formed on a second end of its insulation core. The groove is adapted to receive and surround the tongue. A cooperating engagement means is disposed inside the groove and along the tongue for releasably locking said tongue and groove together when said tongue enters the groove. The engagement means provides a biasing force that resiliently holds the first end and the second end together and provides a heat seal, after said tongue is inserted into said groove past a predetermined point.

In a preferred aspect of the present invention, a refrigeration panel system is provided having a first panel and a second panel. Each of the panels includes an insulation core and a top and a bottom metal skin attached to the insulation core. The first panel includes a groove in an engaging end of the insulation core forming a top and bottom ledge. Each ledge includes an inner surface. The second panel includes a tongue extending from its engaging end having an upper and lower surface. The groove is adapted to receive the tongue. A first pair of mating engagement members is disposed on the inner surface of the top ledge and the inner surface of the bottom ledge. A second pair of mating engagement members is disposed on the upper and lower surface of the tongue. Each engagement member of the first and the second pair of mating engagement members are formed from the ends of the metal skins. The first pair of mating engagement members engages the second pair of mating engagement members when the groove receives the tongue. The first and second pairs of engagement members resiliently hold the engagement ends of the first and second panels together, which forms a heat seal between the first and second panels, after the tongue is inserted into the groove past a predetermined point.

An object of the invention is to provide a refrigeration panel system having two connecting ends of insulation to effectively create an airtight seal between the panels, virtually eliminating any chance for heat infiltration to occur due to a poor seal.

Yet another object of the invention is to provide a refrigeration panel system that may be easily disassembled and repositioned for any reason without causing any damage to the panels.

It is yet a further object of the invention to provide a refrigeration panel system that provides essentially the same amount of insulation throughout the panel including the seam area.

Another object of the invention is to provide a refrigeration panel system that does not require any additional screws or splines to hold it in place.

Another object of the invention is to provide a refrigeration panel system that is easy to install by applying firm, but not extreme, pressure to push two panels together.

It is a further object of the invention to provide a refrigeration panel system that assures a minimum tolerance manufacturing process, such that the ends of the insulation provide enough contact to provide an airtight seal without exerting too much pressure against each other.

These and other objects will become apparent from the following description of a preferred embodiment taken together with the accompanying drawings and the appended claims.

DESCRIPTION OF THE PREFERRED EMBODIMENT

Figure 1:
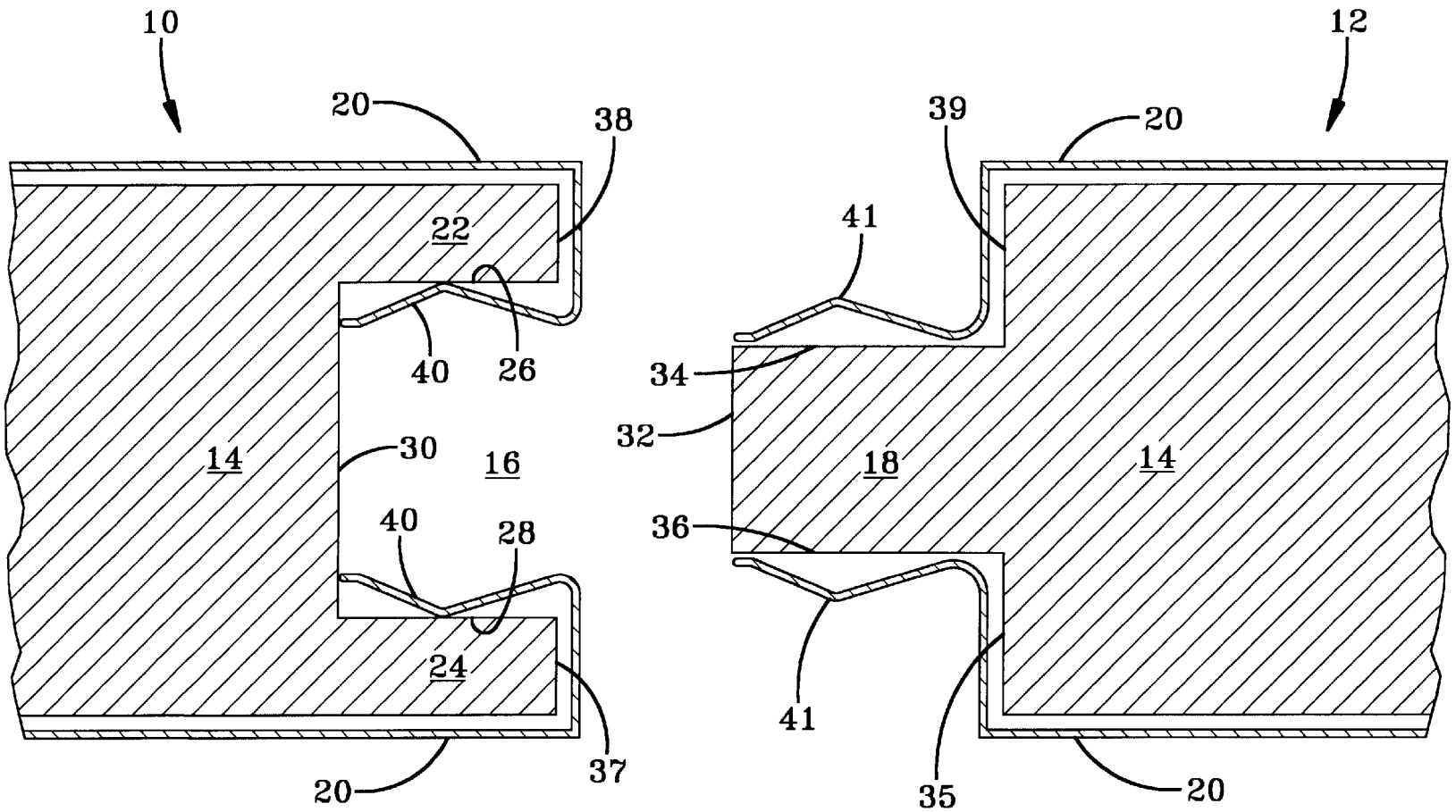
FIG. 1 is a cross sectional, end view showing a first embodiment of the panels in their spaced apart configuration.

Referring now to the drawings wherein the showings are for the purpose of illustrating the preferred embodiment of the invention only, and not for the purpose of limiting the same, FIG. 1 shows a refrigeration panel system comprising a first panel member 10 and a second panel member 12. Both panel members 10 and 12 include an insulation core 14 with a top and bottom surface and an engaging end. Resilient metal skins 20 are attached to the top and bottom surfaces (as shown in the drawings) of insulation core 14.

First panel 10 includes a groove 16, which is defined by a first or upper ledge 22 and a second or lower ledge 24. Upper ledge 22 includes an edge 38 and an inner surface 26. Metal skin 20 extends to the engaging end of the first panel and around edge 38 of ledge 22, and is shaped into an engagement member 40 along inner surface 26 of top insulation ledge 22. Bottom ledge 24 includes an edge 37 and an inner surface 28. A second metal skin extends to the engaging end of the bottom surface of insulation core 14 of first panel 10 and around edge 37 of ledge 24, and is shaped into an engagement member 40 along inner surface 28 of ledge 24. Both engagement members form a first pair of mating engagement members. A general planar surface 30 of insulation core 14 is left exposed to groove 16.

Second panel 12 includes a tongue portion 18 extending from the engaging end of second panel 12. Metal skin 20 extends to the engaging end of the top surface of second panel 12, and is bent at a 90° angle around a surface 39 that is generally perpendicular to the top surface of insulation core 14 and extends to tongue 18. A metal skin extends along the bottom surface of core 14 of second panel 12 to the engaging end, and is bent at a 90° angle around a surface 35 that extends generally perpendicular from the bottom surface of core 14 to tongue 18. Tongue 18 has a generally rectangular configuration and includes a first or upper planar surface 34 and a second or lower planar surface 36 (as shown in the drawings). Engagement members 41 are formed at the end of metal skin 20 along upper planar surface 34 and lower planar surface 36 and form a second pair of mating engagement members. Engagement members 41 are disposed outwardly from upper planar surface 34 and lower planar surface 36 such that there is a space therebetween into which said engagement members 34 may be compressed when the tongue portion 18 is inserted into groove 16. A general flat planar surface 32 of insulation core 14, perpendicular to upper planar surface 34 and lower planar surface 36, is left exposed and is not covered by any portion of metal skins 20.

Figure 2:
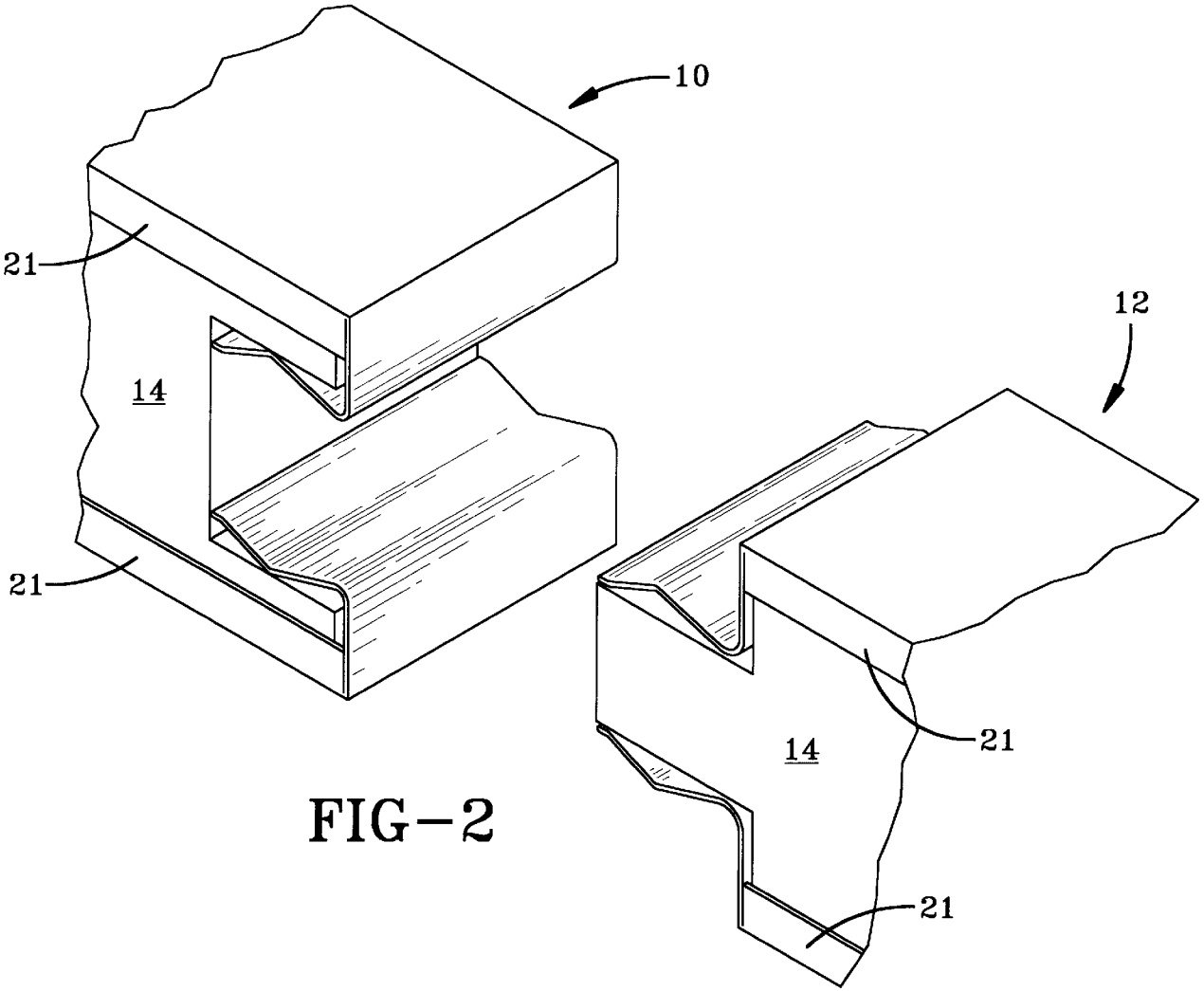
FIG. 2 is a perspective end view of the first embodiment shown in FIG. 1.

Referring to the perspective view of panel 10 and 12 shown in FIG. 2, metal skins 20 can be bent into a lip 21 around insulation core 14 at the top end and the bottom end (not shown) of first panel 10 and 12. Lip 21 may be provided to ensure that the top and bottom ends of the first and second panels do not present safety concerns for installers during installation due to sharp edges. However, other methods may be employed to eliminate the sharp edges, or the installers could wear gloves during the installation phase.

Figure 3:
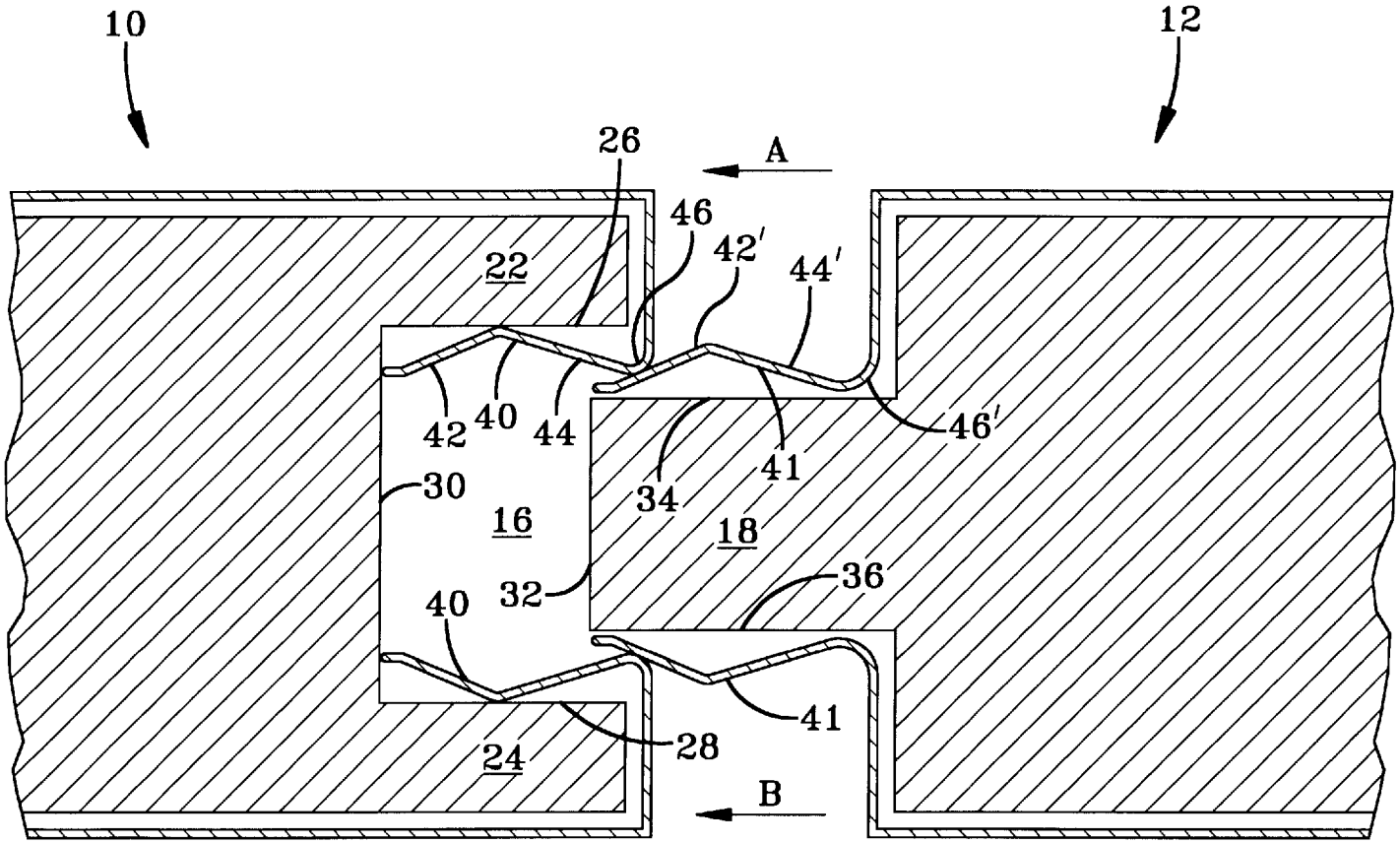
FIG. 3 is a cross sectional, end view of the panels of FIG. 1 partially interconnected together.

As best seen in FIG. 3, engagement members 40 are formed at the end of metal skins 20 and have a generally flat V-shaped configuration. Engagement members 40 each include a rounded portion or corner 46 for joining engagement member 40 to the remainder of metal skin 20. A first ramp portion 44 extends from the rounded portion 46 to a second ramp portion 42 that extends transversely to first ramp portion 44. Engagement members 41 of the second pair of mating engagement members are convex, and are shaped generally similarly to concave engagement members 40 of the first pair of mating engagement members, and include a rounded portion 46' for joining members 41 with the vertical portion of metal skins 20 on panel 12, as shown in the drawings. A first ramp portion 44' extends from the rounded portion 46' to a second ramp portion 42' that extends transversely to first ramp portion 44'. The V-shaped configuration of the first and second mating pairs of engagement members are interlocking, mutually engageable and resilient, as explained below.

Figure 4:
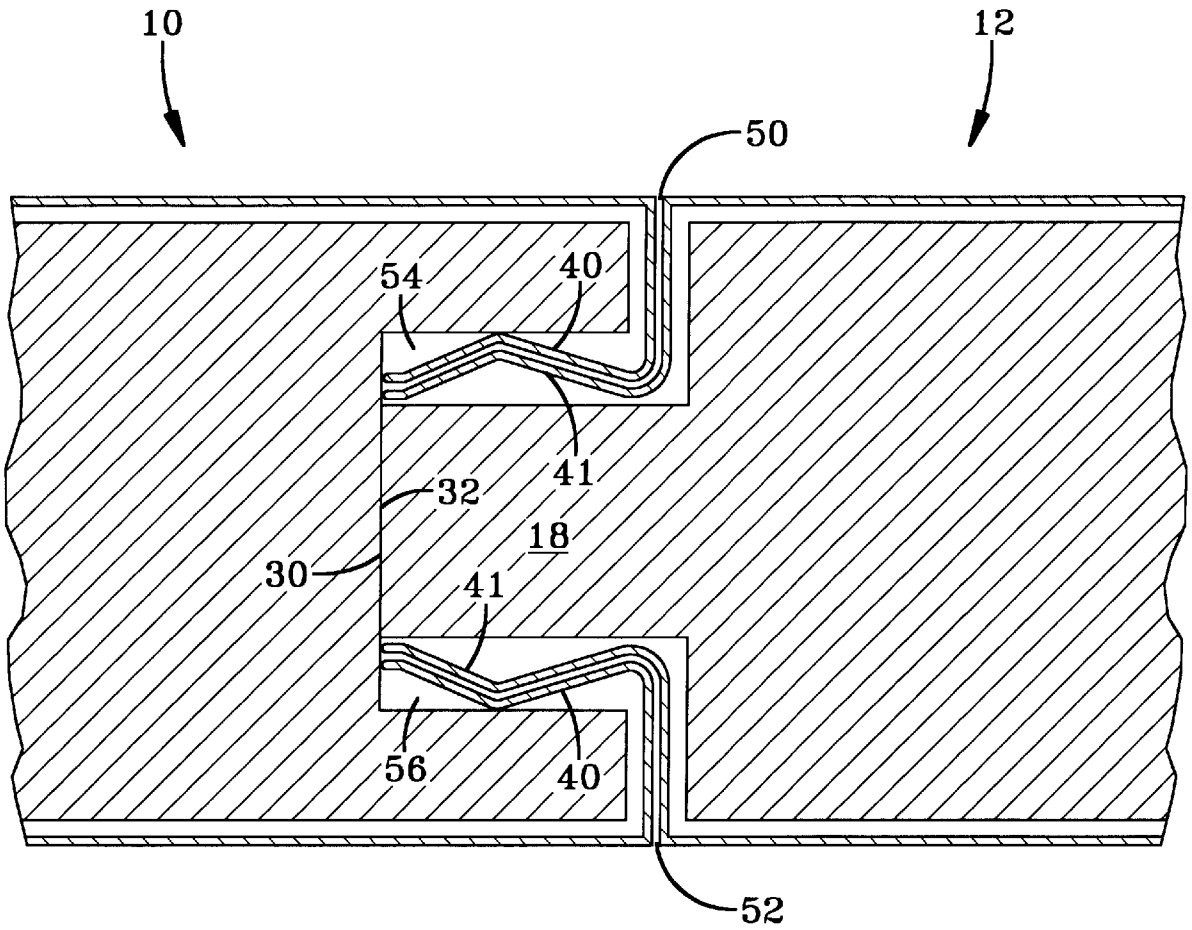
FIG. 4 is a cross sectional, end view of the panels of FIG. 1 in their interlocked configuration.

During installation of the snap together panel system, such as panel 10 and 12 as shown in FIGS. 3 and 4, an installer inserts tongue portion 18 into groove 16 and applies pressure in the directions of arrows A and B. Rounded portions 46 of engagement members 40 ride along second ramp portions 42' of 41. This causes force to be applied on inner surface 26 and 28 of first or upper ledge 22 and second or lower ledge 24, respectively, which in turn causes ledges 22 and 24 to flex slightly outwardly, while engagement members 41 slightly compress. This allows the rounded corners 46 of engagement members 40 to ride up over ramps 42' of engagement members 41, until the rounded corner 46 pass over an intersection of the first ramps 44' and second ramps 42' of engagement members 41. Once the rounded portions have passed these points, ledges 22 and 24 counterflex causing first ramp portions 44 of engagement members 40 to apply pressure to first ramp portions 44' of engagement members 41, which simultaneously return to their decompressed state. A biasing force is provided between the first mating pair of engagement members engaging with the second pair of mating engagement members 41, which resiliently holds panels 10 and 12 to one another. Panels 10 and 12 actually snap together and remaining held firmly together once the tongue is inserted into the groove past a predetermined point, until general planar surface 30 of groove 16 engages with general planar surface 32 of tongue 18. Further, a heat seal is maintained along seams 50 and 52 due to the resilient holding of panels 10 and 12. Since the engagement members engage in gaps 54 and 56, the engagement members are surrounded by insulation and thus the insulation can be maximized along the seam.

Caulking is applied between general planar surfaces 30 and 32 prior to the insertion of tongue 18 into groove 16, providing an airtight seal between the panels, while still making it easy to remove panel 12 from panel 10 without destroying the engagement members because no caulking is used on the metal engagement members. Further, silicone can be applied along the seams of the insulation for additional insulation and sealing. Removal of tongue 18 from groove 16 is accomplished by applying a slightly greater force than was required for inserting tongue 18 into groove 16. Once the caulking seal and silicone seal are broken between generally planar surface 30 and 32, 38 and 39, and 35 and 37, the pressure to remove the tongue is equal to the pressure necessary for inserting tongue 18 into groove 16. No caulking or silicone is applied to the engagement members. Therefore, the panels can be inserted and removed as many times as necessary without any damage to the panels.

Figure 5:
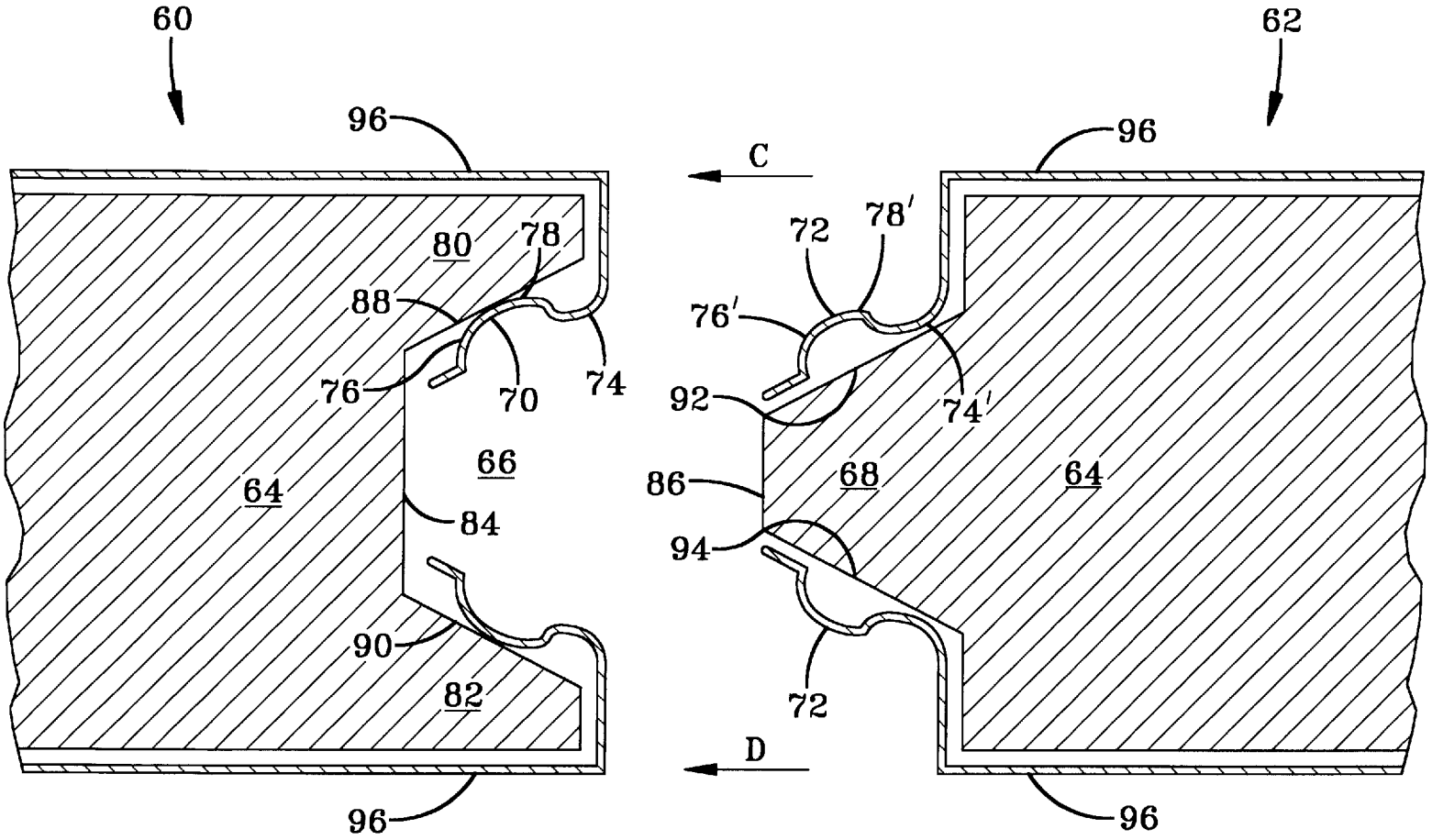
FIG. 5 is a cross sectional, end view showing a second embodiment of the panels in their spaced apart configuration.

It should be appreciated that the tongue and groove portions are not limited to a rectangular configuration. It should also be appreciated that the engagement members are not limited to generally flat V-shaped configuration. For example, as can be seen in FIG. 5, a first panel 60 is provided with an insulation core 64 having a groove portion 66 with a trapezoidal configuration. The groove portion forms a first or upper ledge 80 having an inner surface 88, and second or lower ledge 82 having an inner surface 90 (as shown in the drawings). A metal skin 96 extends to the engaging end of first panel 60 and around ledge 80, forming an engagement member 70 along inner surface 88. A second metal skin extends along the bottom surface of core 64 to the engaging end of first panel 60 and around ledge 82, forming an engagement member 70 along inner surface 90. Engagement members 70 form a first pair of mating engagement members. Second panel member 62 has inner core 64 and a tongue portion 68 extending from the engaging end of core 64. Tongue portion 68 includes a first or upper generally planar surface 92 and a second or lower generally planar surface 94. Engagement members 72 extend along upper planar surface 92 and lower planar surface 94 to form a second pair of mating engagement members. Engagement members 70, each include a rounded portion 74 and engagement members 72, each include a rounded portion 74'. Each extend from the end of metal skin 96 to a rounded ramp portion 78 and 78', respectively, and farther extend along in a curved manner to a second rounded ramp portion 76 and 76', respectively.

Similar to the previous embodiment, tongue portion 68 of second panel member 62 is inserted into groove 66 of first panel member 60 and pressure applied in the directions of arrows C and D. Rounded portions 74 of engagement member 70 rides along ramp 76' of engagement members 72, until it reaches the top of ramp 76', where rounded portion 74 begins to ride down the ramp portion 78' of mating engagement member 72. As previously described during this process, ledge members 80 and 82 flex outwardly and engagement members 72 compress during insertion. Once rounded portion 74 begins down ramp portion 78', ledge members 80 and 82 counterflex and engagement members 72 decompress. First pair of mating engagement members 70 engage with the second pair of mating engagement members 72 causing a biasing force that results in panels 60 and 62 snapping together (with engagement members 72 telescoping into engagement members 70) and remaining firmly held in place. The general planar surface 86 engages the general planar portion 84 causing an airtight seal, as previously described. Further, a heat seal is provided due to the counterflexing of ledges 80 and 82 and decompressing of engagement members 72, which causes the tongue portion to be snapped into the groove portion resiliently holding the two panels in place.

Figure 6:
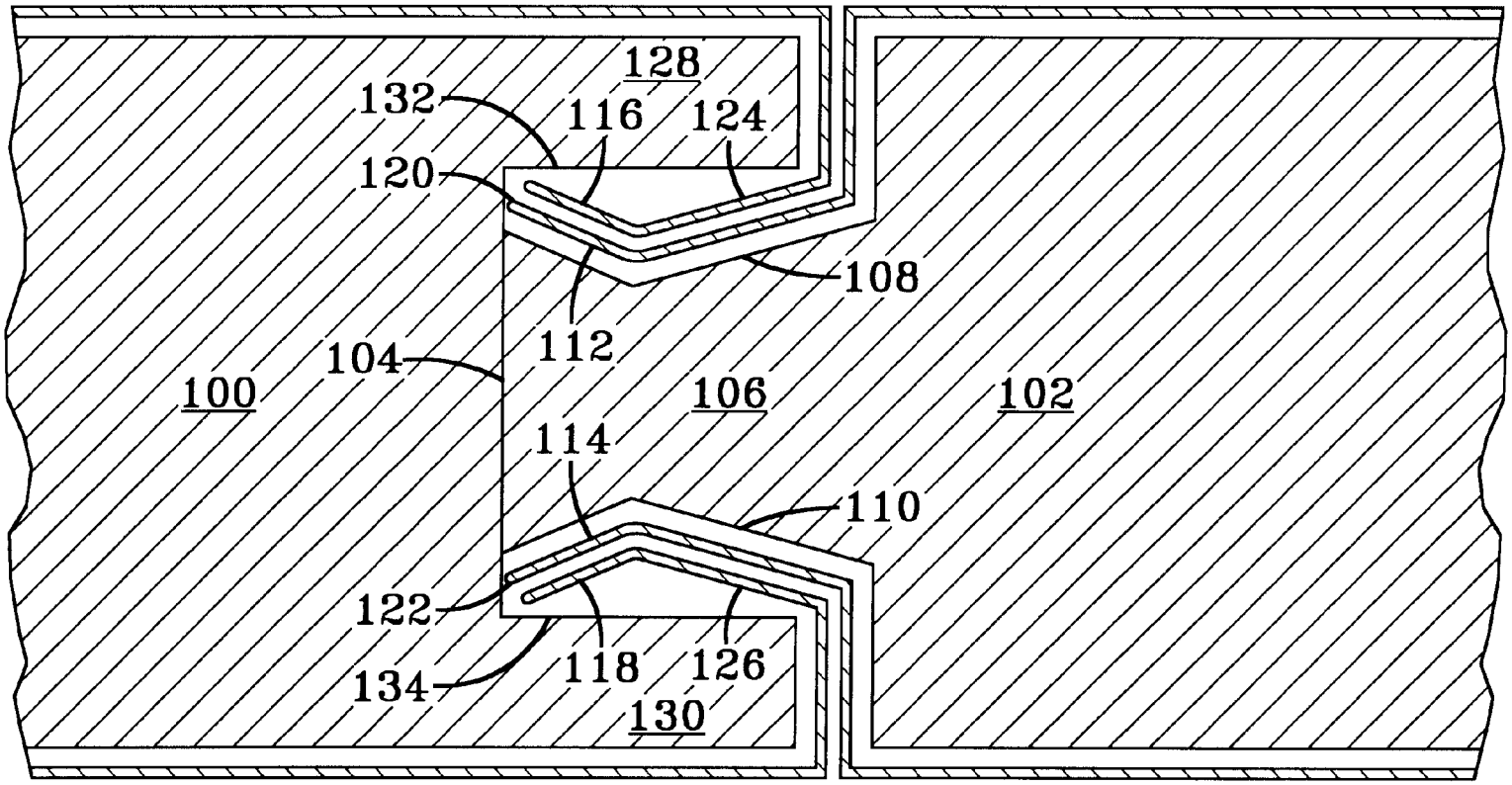
FIG. 6 is a cross sectional, end view showing a third embodiment of the panels in their spaced apart configuration.

It should be appreciated that the top and bottom of both the tongue and the groove portion do not necessarily have to be formed from a single planar surface. As can be seen in FIG. 6, a first panel member 100 is provided with a groove portion 104 similar to the groove portion shown in FIG. 1, and a pair of V-shaped engagement members 116 and 118 are disposed in groove portion 104 forming a first mating pair of engagement members. A second panel 102 is provided with a tongue portion 106 similar to the tongue portion shown in FIG. 1; however, a pair of V-shaped channels 108 and 110 are provided in the top and bottom surfaces of tongue portion 106. V-shaped channel 108 and 110 are dimensioned to receive V-shaped engagement members 112 and 114, respectively. V-shaped engagement members 112 and 114 form a second pair of engagement members. In this particular embodiment of the invention, the direction of the V-shaped engagement members, disposed on tongue portion 102 and in the groove portion 104, are reversed with respect to the configuration shown in FIG. 1. This embodiment provides that a corner 120 and 122 of mating engagement member 112 and 114 ride along a ramp portion 124 and 126, respectively, of engagement members 116 and 118, when tongue portion 106 is inserted into groove portion 108. This causes ledge 128 and 130 to flex outwardly, until corners 120 and 122 pass predetermined points, respectively, in which ledges 128 and 130 counterflex, and a biasing force is exerted on the second pair of engagement members from the first pair of engagement members causing panels 100 and 102 to snap together and be held firmly in place. Although engagement members 120 and 122 do not compress, and thus do not aid in the biasing force provided by members 124 and 126, the configuration minimizes the elimination of insulating core necessary to provide space for the engagement members. It should be appreciated that channels could be provided in surfaces 132 and 134 of ledges 128 and 134 with the engagement members disposed therein. The biasing force would then have to be provided by the compression of the second pair of engagement members, as opposed to the counterflexing of the ledges.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalence thereof.

What is claimed is:

1. A refrigerator panel system comprising:

a first panel and second panel, each of said panels having an insulation core, said first panel having a groove in a first end of said insulation core, said groove having a first ledge and a second ledge, and said second panel having a tongue formed on a second end of said insulation core, said tongue having a first surface and a second surface, said groove being adapted to receive and surround said tongue; and cooperating resilient engagement means disposed inside said groove and along said tongue for releasably locking said tongue and said groove together when said tongue enters said groove, said engagement means providing a biasing force that resiliently holds said first end and said second end together in a manner that prevents play between said first panel and said second panel once joined, and provides a heat seal between said first end and said second end after said tongue is inserted into said groove past a predetermined point;

said engagement means comprising:

a top metal skin and a bottom metal skin attached to said insulation core of said first panel and wrapped around said insulation core of said first panel into said groove, said top and bottom metal skin being bent to form a space between said skin of the surface of said groove to form a first part of said resilient engagement means; and a top metal skin and a bottom metal skin attached to said insulation core of said second panel and wrapped around said insulation core of said tongue said top and bottom metal skin being bent to form a space between said skin and said first surface and said second surface of said tongue to form a second part of said resilient engagement means for cooperating with said first part of said resilient engagement means to resiliently compress the respective skins into the respective spaces.

2. The refrigeration panel system of claim 1, wherein said first panel and said second panel are replaceably removable such that a plurality of first and second panels may be placed adjacent one after the other to form a temporary or permanent heat and airtight structure with an interior volume wherein any one of said plurality first and second panels may be replaced by pulling said tongue of said second panel from the groove of said adjacent first panel.

3. The refrigeration panel system of claim 2, wherein said engagement members have a generally interlocking, mutually engageable flat V-shaped configuration.

4. The refrigeration panel system of claim 1:, wherein said engagement members have a generally flat U-shaped configuration.

5. The refrigeration panel system of claim 1, wherein said engagement end of said first panel and said second panel each have a generally planar surface disposed on both sides of said tongue and groove that make contact with one another when said tongue is received in said groove, and caulking may be applied between said planar surfaces to provide an airtight seal between said first panel and said second panel without destroying the engagement members.

6. The refrigeration panel system of claim 1, wherein said tongue and said groove each have a generally rectangular shape.

7. The refrigeration panel of claim 1, wherein said tongue includes a channel formed along the first and second surface of said tongue, and said engagement means includes an first engagement member disposed inside said channel of the first surface of said tongue and a second engagement member disposed inside said channel of the second surface of said tongue.

8. The refrigeration panel of claim 1, and further including a first ledge disposed above said groove and a second ledge disposed below said groove wherein said biasing force is provided by the flexing of said ledges when said tongue is inserted into said groove, and the counterflexing of said ledges upon insertion of the said tongue into said groove past a predetermined point.

9. The refrigeration panel system of claim 1, wherein said biasing force is also provided by the compressing of said engagement means when said tongue is inserted into said groove and decompressing of said engagement means when said tongue is inserted into said groove past a predetermined point.

10. A refrigeration panel system comprising:

a first panel and a second panel, each of said panels having an insulation core and a top and a bottom metal skin attached to said insulation core, said first panel having a groove in an engaging end of said insulation core forming a first ledge and a second ledge, each ledge having an edge and an inner surface, said second panel having a tongue extending from its engaging end, said tongue having a first surface and a second surface, said groove being adapted to receive said tongue;

a first pair of mating engagement members disposed on the inner surface of said first ledge and the inner surface of said second ledge;

a second pair of mating engagement members disposed outwardly on the first surface and second surface of said tongue with a space resulting therebetween where said mating engagement members may be compressed each of said first and second pair of engagement members being formed from one end of the metal skins, wherein said first pair of mating engagement members engages said second pair of mating engagement members when said groove receives said tongue and said first and second pairs of engagement members resiliently hold said engagement ends of said first and second panels together and forms a heat seal between said first and second panel, after said tongue is inserted into said groove past a predetermined point.

11. The refrigeration panel system of claim 10, wherein said engagement end of said first panel and said second panel each have a generally planar surface disposed on both sides of said tongue and groove that make contact with one another when said tongue is received in said groove, and caulking may be applied between said planar surfaces to provide an airtight seal between said first panel and said second panel while still making it easy to remove said first panel from said second panel without destroying the engagement members.

12. The refrigeration panel system of claim 11, wherein each engagement member of said first and second pair of mating engagement members have a generally flat V-shaped configuration.

13. The refrigeration panel system of claim 11, wherein each engagement member of said first and second pair of mating engagement members have a generally flat U-shaped configuration.

14. The refrigeration panel system of claim 10, wherein said tongue and said groove each have a generally planar insulation surface that make contact with one another when said tongue is received in said groove.

15. The refrigeration panel system of claim 10, wherein said tongue and said groove each have a generally rectangular shape.

16. The refrigeration panel system of claim 10, wherein said tongue and said groove each have a generally trapezoidal shape.

17. The refrigeration panel system of claim 10, wherein said tongue includes a first channel formed along the first surface of said tongue and a second channel formed along the second surface of said tongue, and one of said second pair of mating engagement members are disposed inside said first channel and the other of said second pair of mating engagement members are disposed inside said second channel.

18. The refrigeration panel system of claim 10, wherein a biasing force is provided to resiliently hold said first and second panel together, said biasing force is provided by the flexing of said ledges when said tongue is inserted into said groove, and the counterflexing of said ledges upon insertion of the said tongue into said groove past a predetermined point.

19. The refrigeration panel system of claim 8, wherein said biasing force is also provided by the compressing of said first and second pairs of mating engagement members when said tongue is inserted into said groove, and the decompressing of said first and second pairs of mating engagement members when said tongue is inserted into said groove past a predetermined point.

* * * * *